US009611527B2

(12) United States Patent
Meurer et al.

(10) Patent No.: US 9,611,527 B2
(45) Date of Patent: Apr. 4, 2017

(54) METHOD FOR THE HOT-DIP COATING OF A FLAT STEEL PRODUCT CONTAINING 2-35 WT.% OF MN, AND A FLAT STEEL PRODUCT

(75) Inventors: Manfred Meurer, Rheinberg (DE); Martin Norden, Essen (DE); Wilhelm Warnecke, Hamminkeln (DE); Marc Blumenau, Hagen (DE); Matthias Dahlem, Duisbug (DE); Jennifer Schulz, Unna (DE); Klaus Josef Peters, Krefeld (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 1512 days.

(21) Appl. No.: 13/265,573

(22) PCT Filed: Apr. 22, 2010

(86) PCT No.: PCT/EP2010/055334

§ 371 (c)(1),
(2), (4) Date: Dec. 28, 2011

(87) PCT Pub. No.: WO2010/122097

PCT Pub. Date: Oct. 28, 2010

(65) Prior Publication Data

US 2012/0125491 A1 May 24, 2012

(30) Foreign Application Priority Data

Apr. 23, 2009 (DE) ..... 10 2009 018 577

(51) Int. Cl.
*C23C 2/02* (2006.01)
*C23C 2/04* (2006.01)
(Continued)

(52) U.S. Cl.
CPC . *C23C 2/02* (2013.01); *C23C 2/06* (2013.01)

(58) Field of Classification Search
CPC .... C23C 2/06; C23C 2/00; C23C 2/02; C23C 2/04; C23C 2/12; C23C 2/40; C21D 1/26; C21D 1/76; C21D 6/005
(Continued)

(56) References Cited

U.S. PATENT DOCUMENTS 6,387,192 B1 5/2002 Frommeyer et al.
7,556,865 B2 7/2009 Drillet et al.
(Continued)

FOREIGN PATENT DOCUMENTS

BE 1011131 A6 5/1999
DE 19727759 A1 1/1999
(Continued)

OTHER PUBLICATIONS

Hosking, N.c., M.a. Ström, P.h. Shipway, and C.d. Rudd. "Corrosion Resistance of Zinc-magnesium Coated Steel." Corrosion Science 49.9 (2007): 3669-695. Science Direct. Web. Dec. 9, 2015.*

*Primary Examiner* — Jessee Roe
*Assistant Examiner* — Anthony Liang
(74) *Attorney, Agent, or Firm* — The Webb Law Firm

(57) ABSTRACT

A method by which a flat steel product containing 2-35 wt. % of Mn can be provided with a coating of Zn which adheres well by annealing at an annealing temperature $T_a$ of 600-1100° C. for an annealing time of 10-240 s under an annealing atmosphere which has a reducing effect on the FeO present on the flat steel product and an oxidizing effect on the Mn contained in the steel substrate thereby forming a layer of Mn mixed oxide which covers the flat steel product at least in sections and then cooling the flat steel product to a temperature for bath entry and conveying it through a bath of molten Zn saturated within iron at a temperature of 420-520° C., within a dip time of 0.1-10 s.

14 Claims, 2 Drawing Sheets

(51) Int. Cl.
*C21D 1/26* (2006.01)
*C21D 1/76* (2006.01)
*C23C 2/06* (2006.01)

(58) Field of Classification Search
USPC ..... 148/533
See application file for complete search history.

(56) References Cited

U.S. PATENT DOCUMENTS

| | | | |
|---|---|---|---|
| 7,588,651 | B2 | 9/2009 | Engl et al. |
| 7,892,654 | B2 | 2/2011 | Hofmann et al. |
| 2008/0053580 | A1 | 3/2008 | Drillet et al. |
| 2008/0083477 | A1* | 4/2008 | Drillet ..... C23C 2/02 148/242 |
| 2010/0062163 | A1 | 3/2010 | Bordignon et al. |
| 2010/0065160 | A1 | 3/2010 | Meurer et al. |

FOREIGN PATENT DOCUMENTS

| | | | |
|---|---|---|---|
| DE | 19900199 | A1 | 7/2000 |
| DE | 10259230 | A1 | 7/2004 |
| DE | 102005008410 | B3 | 2/2006 |
| DE | 102006039307 | B3 | 2/2008 |
| JP | 07-316764 | A | 5/1995 |
| JP | 2003-193213 | A | 7/2003 |
| JP | 2008-517158 | A | 5/2008 |
| WO | 2006042930 | A1 | 4/2006 |
| WO | 2006042931 | A1 | 4/2006 |
| WO | 2007109865 | A1 | 10/2007 |
| WO | 2008022980 | A2 | 2/2008 |

* cited by examiner

METHOD FOR THE HOT-DIP COATING OF A FLAT STEEL PRODUCT CONTAINING 2-35 WT.% OF MN, AND A FLAT STEEL PRODUCT

BACKGROUND OF THE INVENTION

Field of the Invention

The invention relates to a method for the hot-dip coating with zinc or a zinc alloy of a flat steel product containing 2-35 wt. % of Mn and to a flat steel product provided with a coating of zinc or a zinc alloy.

Description of Related Art

In the modern-day automotive industry, increasing recourse is being had to high strength and very high strength steels. Typical alloying elements are, amongst others, manganese, chromium, silicon and aluminium which, when subjected to conventional recrystallisation annealing treatment, form stable, non-reducible oxides on the surface. These oxides may hamper reactive wetting by molten zinc.

Because of the beneficial combination of properties which they have, comprising on the one hand high strengths of up to 1,400 MPa and on the other hand extremely high elongations (uniform elongations of up to 70% and elongations at rupture of up to 90%), steels having high-manganese contents are, basically, particularly suitable for use in the field of vehicle construction and in particular automobile construction. Steels specifically suitable for this purpose having high Mn contents of 6 wt. % to 30 wt. % are known from, for example, DE 102 59 230 A1, DE 197 27 759 C2 or DE 199 00 199 A1. While being of high strength, flat products produced from known steels have isotropic behaviour when being formed and, what is more, are still ductile even at low temperatures.

However, counterbalancing these advantages is the fact that high-manganese steels tend to suffer pitting corrosion and are difficult to passivate. When there is an exposure to increased concentrations of chloride ions, this tendency to suffer corrosion which, though limited locally, is nevertheless severe, is high in comparison with less highly alloyed steels and it makes steels belonging to the group of high-alloy sheet steels difficult to use in the very field of bodywork construction. What is more, high-manganese steels also have a tendency to suffer surface corrosion, which is likewise a factor which limits the range over which they can be used.

It has therefore been proposed that flat steel products produced from high-manganese steels should also be provided in a manner known per se with a metallic coating which will protect the steel against corrosive attack. As well as revealing fundamental problems relating to wetting by the molten Zn, particularly with regard to the adhesion to the steel substrate which the coating is required to show during cold forming, practical attempts to provide steel strip containing high manganese contents with a metallic protective coating by hot-dip coating able to be carried out at low cost have failed to produce satisfactory results.

The reason for the poor adhesion properties was determined to be the thick layer of oxide which forms in the course of the annealing which is indispensable for the hot-dip coating. The surfaces of sheet metal which have oxidised in this way can no longer be wetted with the requisite uniformity and completeness by the coating metal, which means that the aim of corrosion protection covering the full area is not achieved.

Possible ways of improving wettability by applying an intermediate layer of Fe or Ni which were known from the field of high-alloy steels but ones having lower Mn contents failed to achieve the desired success with sheet steel containing at least 6 wt. % of manganese.

It has been proposed in DE 10 2005 008 410 B3 that a layer of aluminium be applied to steel strip containing 6-30 wt. % of Mn before the final annealing preceding the hot-dip coating. The aluminium adhering to the steel strip prevents the surface of the latter from oxidising in the course of the annealing of the steel strip which takes place before the hot-dip coating. The layer of aluminium, acting after the fashion of a primer, then causes the coating produced by the hot coating to adhere firmly to the steel strip over its full area even when the steel strip itself does not provide the right prerequisites for this due to its alloyed nature. For this purpose, advantage is taken in the known method of the effect that a diffusion of the iron from the steel strip into the layer of aluminium takes places in the course of the annealing treatment which has to precede the hot coating. A metallic overlay, consisting substantially of Al and Fe, which is connected by a firm bonding mechanism to the substrate formed by the steel strip, thus builds up on the steel strip in the course of the annealing.

A different method of coating a high-manganese steel strip containing 0.35-1.05 wt. % of C, 16-25 wt. % of Mn and remainder iron plus unavoidable impurities is known from WO 2006/042931 A1. In this known method, the steel strip of the above composition is first cold-rolled and then recrystallisation annealed in an atmosphere which is reducing in relation to iron. The annealing parameters are selected in this case to be such that an intermediate layer which is substantially entirely composed of amorphous (FeMn) oxide comes into being on both sides of the steel strip, and in addition there comes into being an outer layer which is composed of crystalline Mn oxide, the thickness of the two layers being at least 0.5 μm. There is no longer any hot-dip coating following this. Instead, it is the layer of Mn oxide in combination with the layer of (FeMn) oxide which is intended to provide adequate corrosion protection.

Based on a similar principle is the method described in WO 2006/042930 (EP 1 805 341 B1), in which, by two successive annealing steps, a layer of iron and manganese mixed oxides is first produced on the high-manganese steel substrate and an outer layer comprising Mn mixed oxides is then produced on this first layer. The steel strip which has been coated in this way is then conveyed into a bath of molten metal. As well as zinc, this bath of molten metal contains in addition a quantity of aluminium which is sufficient to reduce the layer of MnO completely and the layer of (FeMn)O at least partly. The intention is, as a result, to obtain a layered structure in which three layers of FeMnZn and an outer layer of Zn can be identified.

Practical studies have shown that even in steel strip which has been precoated in such a complicated and expensive way there is not, in practice, the adhesion to the steel substrate which is required for cold forming. Moreover, the method known from WO 2006/042930 proves not to be sufficiently reliable in operation due to the reactions which take place in the bath of molten metal, which are hardly possible to control in practice.

Finally, there is known from DE 10 2006 039 307 B3 a method for the hot-dip coating of a steel substrate having high Mn contents in which, to produce on the steel strip a metallic protective layer which is substantially free of oxidic intermediate layers, the ratio % $H_2O$/% $H_2$ of the water content % $H_2O$ to the hydrogen content % $H_2$ of the annealing atmosphere is set in such a way, as a function of the given annealing temperature Ta, that the ratio % $H_2O$/%

$H_2$ is equal to or less than $8 \cdot 10^{-15} \cdot x\ T_a^{3.529}$, where T is the annealing temperature. Underlying this stipulation is the finding that, if the annealing atmosphere is set in a suitable way, namely if its hydrogen content is set in a suitable way in relation to its dew point, the nature of the surface which the steel strip to be coated acquires in the course of the annealing is one which will ensure that the metallic protective coating which is then applied by hot-dip coating will adhere in the optimum way. The annealing atmosphere which has been set in this way has a reducing action on both the iron in the steel strip and on the manganese therein. The aim in this case is to avoid the formation of an oxide layer which would interfere with the adhesion of the molten coating to the substrate of high-manganese steel.

Practical studies have shown that flat steel products prepared by the known method explained above do behave well as far as wetting is concerned and do have adhesion of the Zn coating which is adequate for many applications. However, in the forming of flat steel products coated in this way into components, it has been found that detachments and cracking of the coating still occur when the amounts of deformation are high.

Also, the methods known from the prior art may have an adverse effect on the mechanical properties in the flat steel product, in particular when the process temperatures used are high. Moreover, economical operation which comes into line with environmental requirements is not possible with the existing processes.

Against this background, the object of the invention was to specify a method which allows flat steel products having high contents of Mn to be provided with a zinc coating providing protection against corrosion, in the case of which coating it is ensured that there is a further improvement in the adhesion of the coating to the steel substrate. The intention was also to provide a flat steel product in which the Zn coating, which is formed in any given case from zinc or a zinc alloy, adheres securely to the steel substrate even under large amounts of forming deformation.

SUMMARY OF THE INVENTION

In accordance with the invention, for the hot-dip coating of a flat steel product containing 2-35 wt. % of Mn by a method following a continuous sequence, a flat steel product in the form of a steel strip or steel sheet is first made available.

The procedure followed in accordance with the invention in the coating is particularly suitable for steel strip which is highly alloyed, to ensure high strengths and good elongation properties.

Steel strip which, in a manner according to the invention, can be provided with a metallic protective coating by hot-dip coating typically contains (in percentages by weight) C: ≤1.6%, Mn: 2-35%, Al: ≤10%, Ni: ≤10%, Cr≤10%, Si≤10%, Cu: ≤3%, Nb: ≤0.6%, Ti: ≤0.3%, V: ≤0.3%, P: ≤0.1%, B: ≤0.01%, Mo: ≤0.3%, N: ≤1.0%, remainder iron and unavoidable impurities.

The effects achieved by means of the invention act in a particularly advantageous way in the coating of high alloy steel strip which has manganese contents of at least 6 wt. %. In this way, it has been found that a steel base material which contains (in percentages by weight) C: ≤1.00%, Mn: 20.0-30.0%, Al: 0.5%, Si≤0.5%, B: ≤0.01%, Ni: ≤3.0%, Cr≤10.0%, Cu: ≤3.0%, N: <0.6%, Nb: <0.3%, Ti: <0.3%, V: <0.3%, P: <0.1%, remainder iron and unavoidable impurities can be coated particularly well with a coating providing protection against corrosion.

The same is true when used as a base material is a steel which contains (in percentages by weight) C: ≤1.00%, Mn: 7.00-30.00%, Al: 1.00-10.00%, Si>2.50-8.00% (wherein the sum of the Al and Si contents is >3.50-12.0%), B: <0.01%, Ni: <8.00%, Cu: <3.00%, N: <0.60%, Nb: <0.30%, Ti: <0.30%, V: 0.30%, P: <0.01%, remainder iron and unavoidable impurities.

As in the case of conventional hot-dip coating, the flat steel products which can be coated in a manner according to the invention are both hot rolled and cold-rolled steel strip, the method according to the invention proving particularly successful in processing cold-rolled steel strip.

The flat products which are made available in this way are annealed in a step of operation b). The annealing temperature $T_a$ is 600-1100° C. in this case, while the annealing time for which the flat steel product is kept at the annealing temperature is 10-240 s.

The annealing temperature Ta and annealing time given above have a reducing effect on iron oxide FeO which is present on the flat steel product and an oxidising effect on the manganese contained in the steel substrate. For this purpose, the annealing atmosphere contains 0.01-85 vol. % of H2, H2O and the remainder N2 and unavoidable impurities present for technical reasons and has a dew point lying between −70° C. and +60° C., the H2O/H2 ratio being:

$$8 \cdot 10^{-15} \cdot x T_a^{3.529} < H_2O/H_2 \leq 0.957$$

Hence, in accordance with the invention the $H_2O/H_2$ ratio should be set in such a way that on the one hand it is higher than $8 \cdot 10^{-15} \cdot x\ T_a^{3.529}$ but on the other hand is, at most, equal to 0.957, $T_a$ being the annealing temperature in the given case.

In typical practical applications where the aim is in particular to produce on the given steel substrate, in a manner according to the invention, a coating of zinc alloy containing Mg in a single-stage annealing process, the dew point of the atmosphere is preferably in the range from −50° C. to +60° C. At the same time the annealing atmosphere typically contains 0.1-85 vol. % of $H_2$ in this case. A particularly economical mode of operation for the continuous furnace which is used in accordance with the invention for the annealing can be obtained by keeping the dew point of the atmosphere at −20° C. to +20° C.

The result is that what is produced in this way on the flat steel product by annealing carried out before the hot-dip coating is a 20-400 nm thick layer of Mn mixed oxide which covers the flat steel product at least in sections, it being particularly beneficial with regard to the adhesion of the Zn coating to the steel substrate for the layer of Mn mixed oxide to cover substantially the whole of the surface of the flat steel product after the annealing. The layer of Mn mixed oxide is defined within the meaning of the invention as $MnO.Fe_{Metal}$, i.e. it is metallic iron and not, as in the prior art, oxidised iron which is present in this layer of Mn mixed oxide.

Hence, by means of at least one annealing stage, a layer of Mn mixed oxide is specifically set to occur by carrying out the annealing (step of operation b)) under an atmosphere which is reducing for FeO and oxidising for Mn.

Surprisingly, it has been found that there is obtained in this way a flat steel product which ensures good wetting in the hot-dip coating which is then carried out. Equally, the layer of Mn mixed oxide which is produced in accordance with the invention on the steel substrate forms a primer to which, surprisingly, the layer of zinc which is then applied adheres particularly securely. The layer of Mn mixed oxide is maintained in this case to a very large degree during the hot-dip coating process and there is thus a guarantee of durable cohesion between the Zn coating and the steel substrate even in the finished product.

After the annealing step explained above, the annealed flat steel product is cooled to a temperature for bath entry at which it enters the bath of molten Zn. The temperature for bath entry of the flat steel product is typically in the range from 310 to 710° C.

The flat steel product which has been cooled to the temperature for bath entry is then conveyed, within a dip time of 0.1-10 seconds, in particular 0.1-5 s, through a bath of molten Zn saturated with iron which is at a temperature of 420-520° C. and which contains, as well as the main constituent zinc and unavoidable impurities, 0.05-8 wt. % of Al and/or up to 8 wt. % of Mg, in particular 0.05-5 wt. % of Al and/or up to 5 wt. % of Mg. Present in addition in the molten bath optionally are Si<2%, Pb<0.1%, Ti<0.2%, Ni<1%, Cu<1%, Co<0.3%, Mn<0.5%, Cr<0.2%, Sr<0.5%, Fe<3%, B<0.1%, Bi<0.1%, Cd<0.1%, to enable certain properties to be set for the coating in a manner which is known per se.

The flat steel product which is obtained in this way, hot-dip coated with a protective Zn coating providing protection against corrosion, is finally cooled, it still being possible for the thickness of the coating to be set in a manner known per se before the cooling.

The Zn coating according to the invention needs to contain Al contents of 0.05-8 wt. % and may have in addition contents of up to 8 wt. % of Mg, the upper limits on the contents of the two elements typically being restricted in practice to a maximum of 5 wt. %.

A flat steel product according to the invention having an Mn content of 2-35 wt. % and a protective Zn coating providing protection against corrosion is therefore characterised in that the protective Zn coating has a layer of Mn mixed oxide which substantially covers and adheres to the flat steel product and a layer of Zn which shields the flat steel product and the layer of Mn mixed oxide adhering thereto from the surroundings.

Particularly good adhesion of the layer of zinc to the steel substrate arises when the protective Zn coating comprises a layer of $Fe(Mn)_2Al_5$ arranged between the layer of Mn mixed oxide and the layer of Zn. This layer occurs when an adequate amount of aluminium of 0.05-5 wt. % of Al is present in the molten bath. The layer of $Fe(Mn)_2Al_5$ forms a barrier layer in this case by which the reduction of the layer of Mn mixed oxide is reliably prevented in the hot-dipping. As a function in particular of an Al content of between 0.05 and 0.15 wt. %, the barrier layer is able to convert into FeZn phases, the layer of Mn oxides nevertheless being preserved.

The MnO layer and $Fe(Mn)_2Al_5$ layer of a coating produced in accordance with the invention whose nature is in accordance with the invention thus continue to ensure, even after the hot-dip coating, that the layer of Zn situated on the outside adheres firmly to the steel substrate under large amounts of forming deformation.

However, the presence in accordance with the invention of a layer of Mn mixed oxide on the surface of the steel substrate has a beneficial effect not only when the layer of $Fe(Mn)_2Al_5$ forms in addition but also when magnesium is present in effective quantities in the bath of molten metal as an alternative or in addition to aluminium. Even when a coating layer of ZnMg is produced on the steel substrate, the layer of MnO which is produced in accordance with the invention ensures particularly good and even wetting of the flat steel product with, at the same time, optimum adhesion and a minimised risk of cracking or peeling even at high natural strains.

In this connection, an embodiment of the invention which is particularly well suited to practical purposes is obtained when Al and Mg are present simultaneously, within the limits specified, in the bath of molten metal and when the ratio of the Al content % Al to the Mg content % Mg is: % Al/% Mg<1. Hence, in this embodiment of the invention the Al content of the bath of molten metal is always smaller than its Mg content. This has the advantage that the formation of an interface layer which the invention aims to achieve results within the scope of the method according to the invention in an increase in the metallic iron in the layer of mixed oxide even without a special sequence of annealing steps. Magnesium is notable in this case for having a higher reduction potential to MnO than aluminium. Therefore, when fairly high Mg contents are present in the melted layer, there is a forced dissolution of the MnO structure of the layer of mixed oxide. Because the mixed oxide is more heavily dissolved, more metallic iron "$Fe_{Metal}$" is effectively available, from the "depths" of the layer of mixed oxide, at the reaction front between the layer of mixed oxide and the bath of zinc and the covering interface layer of $Fe(Mn)_2Al_5$ is thus able to form in a particularly effective way as a primer. The MnO reduction by dissolved magnesium therefore contributes in situ with particularly great effectiveness to the formation of an interface layer which is aimed at in accordance with the invention and which ensures particularly good adhesion of the Zn coating.

The annealing step which is carried out in scope of the method according to the invention to prepare for the hot-dip coating may be carried out in one or a plurality of stages. In cases where the annealing is carried out in a single stage, various hydrogen contents are possible in the annealing atmosphere as a function of the dew point. If the dew point is within the range from −70° C. to +20° C., the annealing atmosphere may contain at least 0.01 vol. % of $H_2$ but less than 3 vol. % of $H_2$. If on the other the dew point set is one of at least +20° C. up to and including +60° C., the hydrogen content should be in the range from 3% to 85% for the atmosphere to have a reducing effect on iron. With due allowance for the other parameters which have to be taken into account during the carrying out of the annealing step according to the invention, the reducing effect in relation to the FeO which may possibly be present and the oxidising effect in relation to the Mn present in the steel substrate are reliably achieved in this way.

If on the other hand the flat steel product is to be annealed in two stages before entering the bath of molten metal, then for this purpose the annealing step which is carried out in accordance with the invention may be preceded by an additional annealing step in which the flat steel product is kept at an annealing temperature of 200-1100° C. for an annealing time of 0.1 to 60 s under an atmosphere which is oxidative both to Fe and to Mn and which contains 0.0001-5 vol. % of $H_2$ and, optionally, 200-5500 vol. ppm, of $O_2$ and which has a dew point in the range from −60° C. to +60° C. Following this, the annealing step according to the invention is then carried out at a dew point in the range from −70° C. to +20° C. in an atmosphere containing 0.01-85% hydrogen, with due allowance for the other parameters which have to be taken into account during the carrying out of the annealing step according to the invention, before the flat steel product is conveyed into the bath of molten metal.

Optimum adhesion properties for the Zn coating are obtained in the case of a coating produced in accordance with the invention if the thickness of the layer of Mn mixed oxide obtained after the annealing (step of operation b)) is from 40 to 400 nm, and in particular to 200 nm.

Something which likewise contributes to an optimisation of the behaviour of a flat steel product produced in accordance with the invention when it is formed is for the flat steel product provided with the layer of Mn mixed oxide to be subjected to an over-ageing treatment before it enters the bath of molten metal.

BRIEF DESCRIPTION OF THE DRAWINGS

The invention will be explained in detail by exemplary embodiments below. In the drawings.

DETAILED DESCRIPTION OF THE INVENTION

Figure 2:
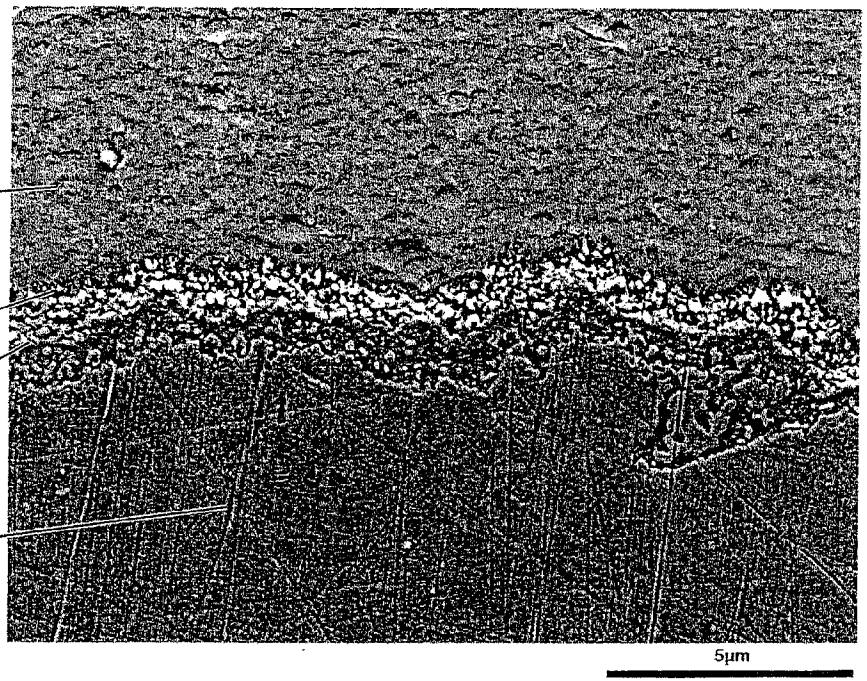
FIG. 2 is a taper microsection of a specimen of a flat steel product provided with a Zn coating.

Cold-rolled steel strip was produced in a known way from a high-manganese steel of the composition given in Table 1.

TABLE 1

| C | Mn | P | Si | V | Al | Cr | Ti | Nb |
|---|---|---|---|---|---|---|---|---|
| 0.634 | 22.2 | 0.02 | 0.18 | 0.2 | 0.01 | 0.08 | 0.001 | 0.001 |

Remainder iron and unavoidable impurities
Figures are in wt. %

A first specimen of the cold-rolled steel strip was then annealed in an annealing process carried out in a single stage.

For this purpose, the specimen of steel strip was heated at a heating rate of 10 K/s to an annealing temperature $T_a$ of 800° C. at which the specimen was then held for 30 seconds. The annealing took place in this case under an annealing atmosphere of which 5 vol. % comprised $H_2$ and 95 vol. % comprised $N_2$ and whose dew point was +25° C. The annealed steel strip was then cooled at a cooling rate of 20 K/s to a temperature for bath entry of 480° C., at which it was first subjected to an over-ageing treatment for 20 seconds. The over-ageing treatment took place in this case under the unchanged annealing atmosphere. Without leaving the annealing atmosphere, the steel strip was then conveyed into a bath of molten zinc saturated with Fe which was at a temperature of 460° C. and which contained, as well as Zn, unavoidable impurities and Fe, 0.23 wt. % of Al in addition. After a dip time of 2 seconds, the steel strip, which had now been hot-dip coated, was conveyed out of the bath of molten metal and was cooled to room temperature.

In a second test, a second specimen of the cold-rolled steel strip of the composition shown in Table 1 was annealed in a two-stage process and then hot-dip coated in a method sequence which it likewise passed through continuously.

For this purpose, the steel strip was first heated at a heating rate of 10 K/s to 600° C. and was held at this annealing temperature for 10 seconds. The annealing atmosphere contained in this case 2000 ppm of $O_2$ and the remainder $N_2$. Its dew point was −30° C.

Immediately following this, in a second annealing step, the steel strip was heated to an annealing temperature $T_a$ of 800° C., at which it was kept for 30 seconds under an annealing atmosphere containing 5 vol. % of $H_2$ and the remainder $N_2$ whose dew point was −30° C. While still under the annealing atmosphere, the steel strip was then cooled at a cooling temperature of approximately 20 K/s to 480° C. and was subjected for 20 seconds to an over-ageing treatment. Following this the steel strip was conveyed, at a temperature for bath entry of 480° C., into a bath of molten metal saturated with Fe which was at a temperature of 460° C. and which once again contained 0.23 wt. % of Al together with other elements in the form of inactive trace impurities and the remainder zinc. After a dip time of 2 seconds, the fully hot-dip coated flat steel product was then conveyed out of the bath of molten metal and was cooled to room temperature.

Figure 1:
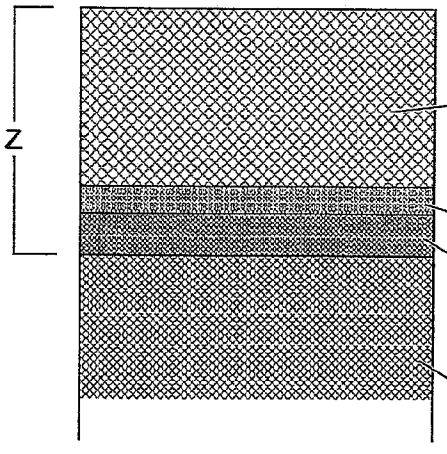
FIG. 1 is a schematic view in section of a flat steel product provided with a Zn coating containing Al.

FIG. 1 is a schematic view of the structure of the coating Z which was obtained in this way on the steel substrate S. It shows that, lying on the steel substrate S, there is a layer M (M=MnO.Fe) of manganese mixed oxide $Mn_yO_x$, on which there has formed an intermediate $Fe(Mn)_2Al_5$ layer F (F=MnO.$Fe(Mn)_2Al_5$) or, when the Al contents of the bath of molten metal are a maximum of 0.15 wt. %, a layer of FeMnZn, which is screened off in turn from the surroundings by a Zn layer Zn (η phase). The thickness of the layer M of Mn mixed oxide is 20-400 nm in this case while the thickness of the intermediate $Fe(Mn)_2Al_5$ layer F is 10-200 nm. The total thickness of the coating layers M and F is thus 20-600 nm. The zinc layer Zn on the other hand is appreciably thicker at 3-20 μm.

Shown in FIG. 2 is a taper microsection of a specimen which was produced in the manner described above. Clearly apparent are the steel substrate S, together with the layer M lying thereon of manganese mixed oxide $Mn_yO_x$ containing interstitial metallic iron, the intermediate $Fe(Mn)_2Al_5$ layer F lying on the layer M of mixed oxide, and the Zn layer lying on the intermediate layer F.

To check the success of the procedure according to the invention, twenty additional tests 1-20 were carried out in each of which the bath of molten metal contained 0.23 wt. % of Al as well as Zn and unavoidable impurities. The degree of wetting and the adhesion of the zinc were examined visually on each of the specimens so obtained. The principle of testing applied was the notch impact test under the German iron and steel testing standard (SEP 1931). The testing parameters and the results of the tests are given in Table 2.

Moreover, a further sixteen tests 21-36 were also performed in which the bath of molten metal contained 0.11 wt. % of Al as well as Zn and unavoidable impurities. As opposed to the barrier layer demonstrated in the above test which took the form of an $Fe(Mn)_2Al_5$ layer, an FeMnZn barrier layer formed when the bath of molten metal had this lower Al content. The degree of wetting and the adhesion of the zinc were likewise examined on each of the specimens so obtained. The testing parameters and the results of the tests are given in Table 3.

On the basis of further specimens of the high-manganese steel strip cold-rolled from the steel of the composition shown in Table 1, the effect of the dew point of the given annealing atmosphere on the results of the coating process was examined. For this purpose, the specimens were each subjected to an annealing process in which they were similarly heated at a heating rate of 10 K/s to an annealing temperature $T_a$ of 800° C. The specimen was then held at this annealing temperature for 60 seconds. The annealing took place in each case under an annealing atmosphere which each time comprised 5 vol. % of $H_2$ and 95 vol. % of $N_2$, with the respective dew points of the annealing atmosphere being varied between −55° C. and +45° C.

After the heat treatment, the annealed steel strip was, as in the series of tests described above, cooled at a cooling rate of 20 K/s to a temperature for bath entry of 480° C., at which it was first subjected to an over-ageing treatment for 20 seconds. The over-ageing treatment took place in this case under the unchanged annealing atmosphere. Without leaving the annealing atmosphere, the steel strip was then conveyed into a bath of molten zinc saturated with Fe which was at a temperature of 460° C. and which contained in respective cases, as well as Zn, unavoidable impurities and Fe, either a combination of 0.4 wt. % of Al and 1.0 wt. % of Mg, or 0.14 wt. %, 0.17 wt. % or 0.23 wt. % of Al alone. After a dip time of 2 seconds, the steel strip, which had now been hot-dip coated, was conveyed out of the bath of molten metal and was cooled to room temperature.

Figure 3:
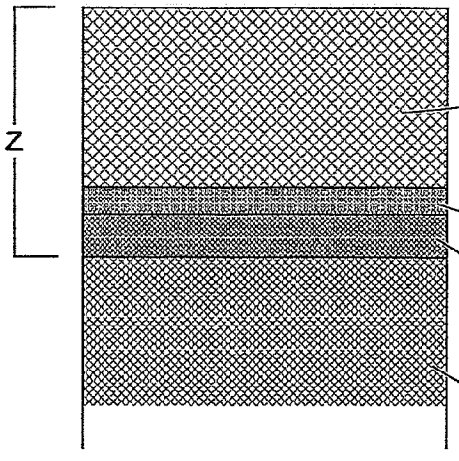
FIG. 3 is a schematic view in section of a flat steel product provided with a ZnMg coating.

FIG. 3 is a schematic view of the structure of the coating Z' which was obtained in this way on the steel substrate S'. It shows that, lying on the steel substrate S', there is a layer M' (M=MnO.Fe) of manganese mixed oxide $Mn_yO_x$, on which there has formed an intermediate $Fe(Mn)_2Al_5$ layer F (F=MnO.$Fe(Mn)_2Al_5$) or, when the Al contents of the bath of molten metal are a maximum of 0.15 wt. %, a layer of FeMnZn, which is screened off in turn from the surroundings by a ZnMg layer. The thickness of the layer M' of Mn mixed oxide is 20-400 nm while the thickness of the intermediate $Fe(Mn)_2Al_5$ layer F' is 10-200 nm. The total thickness of the coating layers M' and F' is thus 20-600 nm. The zinc layer ZnMg on the other hand is appreciably thicker at 3-20 μm.

Figure 4:
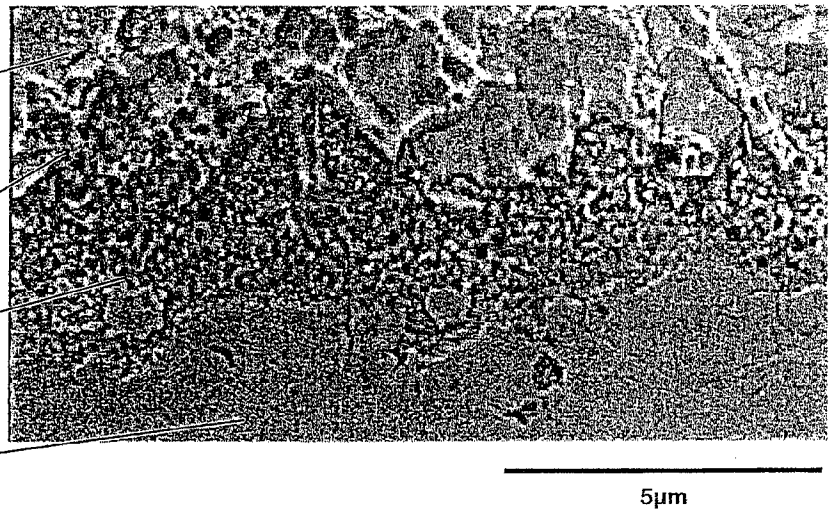
FIG. 4 is a taper microsection of a specimen of a flat steel product provided with a ZnMg coating.

Shown in FIG. 4 is a taper microsection of a specimen which was produced in the manner described above. Clearly apparent are the steel substrate S', together with the layer M' lying thereon of manganese mixed oxide $Mn_yO_x$ containing interstitial metallic iron, the intermediate $Fe(Mn)_2Al_5$ layer F' lying on the layer M of mixed oxide, and the ZnMg layer lying on the intermediate layer F'.

As well as the above-mentioned variation in the dew points of the annealing atmosphere, a variation was also made in the Al and Mg contents of the bath of molten metal in twenty-one tests 37 to 57 which were carried out to check the success of the procedure according to the invention. The degree of wetting and the adhesion of the zinc were examined visually on each of the specimens so obtained. The principle of testing applied in this case too was the notch impact test under Stahl-Eisen Prüfblatt SEP 1931. The testing parameters and the results of the tests are given in Table 4.

It was found that, in the combined presence of Al and Mg and with the dew point set to the range from −50° C. to +60° C., zinc-based coatings could be produced reliably on substrates of high-manganese steel even by the annealing process carried out in a single stage.

To allow a comparison to be made, three more respective specimens V1-V3 and V4-V6 were obtained from cold-rolled steel strip composed of an Al TRIP steel VS1 and from a likewise cold-rolled Si TRIP steel VS2. The compositions of steels VS1 and VS2 are given in Table 5.

TABLE 5

| | C | Mn | P | Si | V | Al | Cr | Ti | Nb |
|---|---|---|---|---|---|---|---|---|---|
| VS1 | 0.22 | 1.1 | 0.02 | 0.1 | 0.002 | 1.7 | 0.06 | 0.1 | 0.001 |
| VS2 | 0.18 | 1.8 | 0.02 | 1.8 | 0.002 | 0 | 0.06 | 0.01 | 0.001 |

Remainder iron and unavoidable impurities
Figures are in wt. %.

The comparative specimens V1-V6 too were heat treated in the manner described above for the specimens according to the invention before they were hot-dip coated in the bath of molten metal. In this case, the bath of molten metal contained, as well as Zn and unavoidable impurities, 0.4 wt. % of Al and 1 wt. % of Mg in the case of each specimen. In this case too, the degree of wetting and the adhesion of the zinc were examined on each of the specimens V1-V6 which had been coated in this way. The testing parameters and the results of the tests are listed in Table 6. It was found that, due to the lower manganese contents of steels VS1 and VS2, an MnO structure did not form in the layer of mixed oxide on the surface of the steel substrate. Consequently, a covering layer of $Fe(Mn)_2$ likewise failed to form as a primer. As a result, sufficient reduction of MnO by dissolved magnesium did not occur in the bath of molten metal and it was thus impossible for adequate wetting and hence adequate adhesion of the coating to be obtained in the comparative specimens.

TABLE 2

| | 1st stage of annealing | | | 2nd stage of annealing | | | | | | In |
|---|---|---|---|---|---|---|---|---|---|---|
| Test no. | Annealing temp. [° C.] | Annealing time [s] | $O_2$ content [ppm] | Annealing temp. $T_a$ [° C.] | Annealing time [s] | $H_2$ content [%] | Dew point [° C.] | Wetting by zinc | Adhesion of zinc | accordance with the invention |
| 1 | Single stage | | | 800 | 60 | 5 | −50 | No | No | No |
| 2 | | | | 800 | 60 | 5 | −30 | No | No | No |
| 3 | | | | 800 | 60 | 5 | −15 | Severely-disrupted | No | No |
| 4 | | | | 800 | 60 | 5 | −5 | Severely disrupted | No | No |
| 5 | | | | 800 | 60 | 5 | 5 | Severely disrupted | No | No |
| 6 | | | | 800 | 60 | 5 | +15 | Disrupted | Limited | No |
| 7 | | | | 800 | 60 | 5 | +25 | Yes | Yes | Yes |
| 8 | | | | 800 | 60 | 5 | +45 | Yes | Yes | Yes |
| 9 | 500 | 10 | 2000 | 800 | 30 | 5 | −30 | Disrupted at points | Yes | Yes |
| 10 | 600 | 10 | 2000 | 800 | 60 | 5 | −30 | Yes | Yes | Yes |
| 11 | 700 | 10 | 2000 | 800 | 30 | 5 | −15 | Disrupted at points | Yes | Yes |

TABLE 2-continued

| | 1st stage of annealing | | | 2nd stage of annealing | | | | | | In |
|---|---|---|---|---|---|---|---|---|---|---|
| Test no. | Annealing temp. [° C.] | Annealing time [s] | $O_2$ content [ppm] | Annealing temp. $T_a$ [° C.] | Annealing time [s] | $H_2$ content [%] | Dew point [° C.] | Wetting by zinc | Adhesion of zinc | accordance with the invention |
| 12 | 800 | 10 | 2000 | 800 | 30 | 5 | −15 | Disrupted at points | Yes | Yes |
| 13 | 500 | 10 | 2500 | 800 | 30 | 5 | −15 | Disrupted at points | Yes | Yes |
| 14 | 600 | 10 | 2500 | 800 | 30 | 5 | −30 | Yes | Yes | Yes |
| 15 | 700 | 10 | 2500 | 800 | 30 | 5 | −30 | Yes | Yes | Yes |
| 16 | 800 | 10 | 2500 | 800 | 30 | 5 | −30 | Yes | Yes | Yes |
| 17 | 500 | 6 | 2500 | 800 | 30 | 5 | −30 | Disrupted at points | Yes | Yes |
| 18 | 600 | 6 | 2500 | 800 | 30 | 5 | −30 | Yes | Yes | Yes |
| 19 | 700 | 6 | 2500 | 800 | 30 | 5 | −30 | Yes | Yes | Yes |
| 20 | 800 | 6 | 2500 | 800 | 30 | 5 | −30 | Yes | Yes | Yes |

TABLE 3

| | 1st stage of annealing | | | 2nd stage of annealing | | | | | | In |
|---|---|---|---|---|---|---|---|---|---|---|
| Test no. | Annealing temp. [° C.] | Annealing time [s] | $O_2$ content [ppm] | Annealing temp. $T_a$ [° C.] | Annealing time [s] | $H_2$ content [%] | Dew point [° C.] | Wetting by zinc | Adhesion of zinc | accordance with the invention |
| 21 | | Single stage | | 800 | 60 | 5 | −50 | No | No | No |
| 22 | | | | 800 | 60 | 5 | −30 | No | No | No |
| 23 | | | | 800 | 60 | 5 | −15 | Severely disrupted | No | No |
| 24 | | | | 800 | 60 | 5 | −5 | Severely disrupted | No | No |
| 25 | | | | 800 | 60 | 5 | +5 | Severely disrupted | No | No |
| 26 | | | | 800 | 60 | 5 | +15 | Disrupted | Limited | No |
| 27 | | | | 800 | 60 | 5 | +25 | Yes | Yes | Yes |
| 28 | | | | 800 | 60 | 5 | +45 | Yes | Yes | Yes |
| 29 | 500 | 10 | 2000 | 800 | 30 | 5 | −30 | Disrupted at points | Yes | Yes |
| 30 | 600 | 10 | 2000 | 800 | 60 | 5 | −30 | Yes | Yes | Yes |
| 31 | 700 | 10 | 2000 | 800 | 30 | 5 | −15 | Disrupted at points | Yes | Yes |
| 32 | 800 | 10 | 2000 | 800 | 30 | 5 | −15 | Disrupted at points | Yes | Yes |
| 33 | 500 | 10 | 2500 | 800 | 30 | 5 | −15 | Disrupted at points | Yes | Yes |
| 34 | 600 | 10 | 2500 | 800 | 30 | 5 | −30 | Yes | Yes | Yes |
| 35 | 700 | 10 | 2500 | 800 | 30 | 5 | −30 | Yes | Yes | Yes |
| 36 | 800 | 10 | 2500 | 800 | 30 | 5 | −30 | Yes | Yes | Yes |

TABLE 4

| | Annealing | | | | Bath of molten metal | | | | In |
|---|---|---|---|---|---|---|---|---|---|
| Test no. | Annealing temp. $T_a$ [° C.] | Holding time [s] | $H_2$ content [%] | Dew point [° C.] | Mg content [wt. %] | Al content [wt. %] | Wetting by zinc | Adhesion of zinc | accordance with the invention |
| 37 | 800 | 60 | 5 | +5 | 1 | 0.4 | Yes | Yes | Yes |
| 38 | 800 | 60 | 5 | +15 | 1 | 0.4 | Yes | Yes | Yes |
| 39 | 800 | 60 | 5 | +25 | 1 | 0.4 | Yes | Yes | Yes |
| 40 | 800 | 60 | 5 | +45 | 1 | 0.4 | Yes | Yes | Yes |
| 41 | 800 | 60 | 5 | −50 | — | 0.14 | No | No | No |
| 42 | 800 | 60 | 5 | −30 | — | 0.14 | No | No | No |
| 43 | 800 | 60 | 5 | −15 | — | 0.14 | No | No | No |
| 44 | 800 | 60 | 5 | −50 | — | 0.17 | No | No | No |
| 45 | 800 | 60 | 5 | −30 | — | 0.17 | No | No | No |
| 46 | 800 | 60 | 5 | −15 | — | 0.17 | No | No | No |
| 47 | 800 | 60 | 5 | −50 | — | 0.23 | No | No | No |
| 48 | 800 | 60 | 5 | −30 | — | 0.23 | No | No | No |
| 49 | 800 | 60 | 5 | −15 | — | 0.23 | No | No | No |
| 50 | 800 | 60 | 5 | −55 | 1 | 0.9 | Disrupted at points | No | No |
| 51 | 800 | 60 | 5 | −30 | 1 | 0.9 | Yes | Yes | Yes |

TABLE 4-continued

| | Annealing | | | | Bath of molten metal | | | | In |
|---|---|---|---|---|---|---|---|---|---|
| Test no. | Annealing temp. $T_a$ [° C.] | Holding time [s] | $H_2$ content [%] | Dew point [° C.] | Mg content [wt. %] | Al content [wt. %] | Wetting by zinc | Adhesion of zinc | accordance with the invention |
| 52 | 800 | 60 | 5 | −15 | 1 | 0.9 | Yes | Yes | Yes |
| 53 | 800 | 60 | 5 | −5 | 1 | 0.9 | Yes | Yes | Yes |
| 54 | 800 | 60 | 5 | −55 | 5 | 1 | Disrupted at points | No | No |
| 55 | 800 | 60 | 5 | −30 | 5 | 1 | Yes | Yes | Yes |
| 56 | 800 | 60 | 5 | −15 | 5 | 1 | Yes | Yes | Yes |
| 57 | 800 | 60 | 5 | −5 | 5 | 0.4 | Yes | Yes | Yes |

TABLE 6

| | | Annealing | | | | Bath of molten metal | | | | In |
|---|---|---|---|---|---|---|---|---|---|---|
| Test no. | Steel | Annealing temp. $T_a$ [° C.] | Holding time [s] | $H_2$ content [%] | Dew point [° C.] | Mg content [wt. %] | Al content [wt. %] | Wetting by zinc | Adhesion of zinc | accordance with the invention |
| V1 | VS1 | 800 | 60 | 5 | −50 | 1 | 0.4 | No | No | No |
| V2 | VS1 | 800 | 60 | 5 | −30 | 1 | 0.4 | No | No | No |
| V3 | VS1 | 800 | 60 | 5 | −15 | 1 | 0.4 | No | No | No |
| V4 | VS2 | 800 | 60 | 5 | −50 | 1 | 0.4 | No | No | No |
| V5 | VS2 | 800 | 60 | 5 | −30 | 1 | 0.4 | No | No | No |
| V6 | VS2 | 800 | 60 | 5 | −15 | 1 | 0.4 | No | No | No |

The invention claimed is:

1. A flat steel product comprising a steel substrate having an Mn content of 2-35 wt. % and a Zn protective coating formed by zinc or a zinc alloy which provides protection against corrosion, wherein the protective Zn coating comprises a layer of Mn mixed oxide which substantially covers and adheres to the flat steel product and a layer of Zn which shields the flat steel product and the layer of Mn mixed oxide adhering thereto from the surroundings and wherein the Mn mixed oxide is $MnO.Fe_{Metal}$.

2. The flat steel product according to claim 1, wherein the protective Zn coating further comprises a layer of $FeMn_2Al_5$ arranged between the layer of Mn mixed oxide and the layer of Zn.

3. The flat steel product according to claim 1, wherein the protective Zn coating further comprises a layer of FeMnZn which is situated between the layer of Mn mixed oxide and the layer of Zn.

4. The flat steel product according to claim 1, wherein the protective Zn coating takes the form of a coating of ZnMg alloy.

5. The flat steel product according to claim 1, wherein the flat steel product is produced by a method comprising:

a) providing the flat steel product;

b) annealing the flat steel product;

at an annealing temperature Ta of 600-1100*C, for an annealing time of 10-240 s under an annealing atmosphere which has a reducing effect on the FeO present on the flat steel product and an oxidising effect on the Mn contained in the steel substrate and which annealing atmosphere contains 0.01-85 vol. % of H2, $H_2O$ and the remainder $N_2$ and unavoidable impurities present for technical reasons and which has a dew point lying between −70° C. and +60° C., the $H_2O$/H2 ratio being:

$$8\cdot10^{-15}-xT_a^{3.529}<H_2O/H2\leq0.957,$$

thereby producing on the flat steel product a 20-400 nm thick layer of $MnO.Fe_{Metal}$ which covers the flat steel product at least in sections, c) cooling the annealed flat steel product to a temperature for bath entry;

d) conveying the flat steel product which has been cooled to the temperature for bath entry through a bath of molten Zn saturated within iron and which is at a temperature of 420-520° C., within a dip time of 0.1-10 s, the flat steel product thus being hot-dip coated with a protective coating of Zn providing protection against corrosion, the bath of molten Zn containing, as well as the main constituent zinc and unavoidable impurities, 0.05-8 wt. % of Al and/or up to 8 wt. % of Mg, and, optionally, Si<2%, Pb<0.1%, Ti<0.2%, Ni<1%, Cu<1%, Co<0.3%, Mn<0.5%, Cr<0.2%, Sr<0.5%, Fe<3%, B<0.1%, Bi<0.1%, Cd<0.1%; and, e) cooling the flat steel product provided with the Zn coating which emerges from the bath of molten metal.

6. A method for producing the flat steel according to claim 1, comprising:

a) providing the flat steel product;

b) annealing the flat steel product;

at an annealing temperature Ta of 600-1100*C, for an annealing time of 10-240 s under an annealing atmosphere which has a reducing effect on the FeO present on the flat steel product and an oxidising effect on the Mn contained in the steel substrate and which annealing atmosphere contains 0.01-85 vol. % of H2, $H_2O$ and the remainder $N_2$ and unavoidable impurities present for technical reasons and which has a dew point lying between −70° C. and +60° C., the $H_2O$/H2 ratio being:

$$8\cdot10^{-15}-xT_a^{3.529}<H_2O/H2\leq0.957,$$

thereby producing on the flat steel product a 20-400 nm thick layer of $MnO.Fe_{Metal}$ which covers the flat steel product at least in sections, c) cooling the annealed flat steel product to a temperature for bath entry;

d) conveying the flat steel product which has been cooled to the temperature for bath entry through a bath of molten Zn saturated within iron and which is at a temperature of 420-520° C., within a dip time of 0.1-10 s, the flat steel product thus being hot-dip coated with a protective coating of Zn providing protection against corrosion, the bath of molten Zn containing, as well as the main constituent zinc and unavoidable impurities, 0.05-8 wt. % of Al and/or up to 8 wt. % of Mg, and, optionally, Si<2%, Pb<0.1%, Ti<0.2%, Ni<1%, Cu<1%, Co<0.3%, Mn<0.5%, Cr<0.2%, Sr<0.5%, Fe<3%, B<0.1%, Bi<0.1%, Cd<0.1%; and, e) cooling the flat steel product provided with the Zn coating which emerges from the bath of molten metal.

7. The method according to claim 6, wherein the flat steel product is made available in the form of a cold-rolled steel strip.

8. The method according to claim 6, wherein the annealing is preceded by an annealing step in which the flat steel product is kept at an annealing temperature of 200-1100° C. for an annealing time of 0.1 to 60 s under an atmosphere which is oxidative to Fe and Mn and which contains 0.0001-5 vol. % of H2 and, optionally, 200-5500 vol. ppm of O2 and which has a dew point in the range from −60° C. to +60° C.

9. The method according to claim 6, wherein the thickness of the layer of $MnO.Fe_{Metal}$ obtained after annealing is 40-400 nm.

10. The method according to claim 6, wherein the layer of $MnO.Fe_{Metal}$ substantially covers the whole of the surface of the flat steel product after the annealing of the flat steel product.

11. The method according to claim 6, wherein the dip time in the bath of molten Zn is 0.1-5 s.

12. The method according to claim 6, wherein the bath of molten Zn contains both Al and Mg.

13. The method according to claim 12, wherein the Al content of the bath is smaller than the Mg content thereof.

14. The method according to claim 6, wherein the temperature for bath entry of the flat steel product is 360-710° C.

* * * * *